US010690434B1

(12) United States Patent
Ding et al.

(10) Patent No.: US 10,690,434 B1
(45) **Date of Patent: *Jun. 23, 2020**

(54) FIREARM SUPPORT AND RELATED METHOD OF USE

(71) Applicant: Leapers, Inc., Livonia, MI (US)

(72) Inventors: Tai-lai Ding, Northville, MI (US); Tat Shing Yu, Plymouth, MI (US); Hsien Jen Tseng, Livonia, MI (US)

(73) Assignee: Leapers, Inc., Livonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/404,944

(22) Filed: May 7, 2019

Related U.S. Application Data

(63) Continuation of application No. 16/247,162, filed on Jan. 14, 2019, now Pat. No. 10,323,897.

(51) Int. Cl.

| | |
|---|---|
| ***F41A 23/02*** | (2006.01) |
| ***F41A 23/10*** | (2006.01) |
| ***F41A 23/14*** | (2006.01) |
| ***F41A 23/06*** | (2006.01) |

(52) U.S. Cl.
CPC ..... *F41A 23/02* (2013.01); *F41A 23/06* (2013.01); *F41A 23/10* (2013.01); *F41A 23/14* (2013.01)

(58) Field of Classification Search
CPC ..... F41A 23/02; F41A 23/06; F41A 23/10; F41A 23/14
USPC ..... 42/94
See application file for complete search history.

(56) References Cited

U.S. PATENT DOCUMENTS

| | | | | |
|---|---|---|---|---|
| 271,251 A * | 1/1883 | Leerbach et al. | ..... | F41A 23/10 42/94 |
| 575,529 A * | 1/1897 | Stephens | ..... | B62H 1/06 280/300 |
| 579,529 A * | 3/1897 | Bauercamper | ..... | E06B 7/18 49/320 |
| 721,425 A * | 2/1903 | Clyde | ..... | F41A 23/18 248/170 |
| 1,295,688 A * | 2/1919 | Butler | ..... | F41A 23/08 42/94 |

(Continued)

OTHER PUBLICATIONS

Leapers, Inc. 2018 Catalog, Bipods & Shooting Stands, pp. 102-113.

(Continued)

*Primary Examiner* — Michelle Clement
(74) *Attorney, Agent, or Firm* — Warner Norcross + Judd, LLP

(57) ABSTRACT

A support pod that supports a weapon in a firing position includes a support tube telescopingly joined with a leg having a longitudinal axis. A lock portion defines grooves downwardly angled relative to the longitudinal axis. A guide portion defines recesses downwardly angled relative to the axis. The recesses can be distal and separate from the grooves, and both optionally are downwardly spiraling. The leg is operable in a locked mode, in which a lock element is in a groove, and a guide element is in a corresponding recess, to set a first overall length of the support. The leg can operate in an adjustment mode in which the lock and guide element can transition out from the groove and recess, and can move to other respective grooves and recesses chosen by a user to set the pod at another overall length. A related method of use is provided.

20 Claims, 10 Drawing Sheets

(56) References Cited

U.S. PATENT DOCUMENTS 1,355,660 A * 10/1920 Farquhar ..... F41A 17/56 42/94
1,382,409 A * 6/1921 Butler ..... F41A 23/08 42/94
1,580,406 A * 4/1926 Browning ..... F41A 23/08 42/94
2,386,802 A * 10/1945 Johnson, Jr. ..... F41A 23/00 42/94
2,436,349 A * 2/1948 Adams ..... F41A 23/08 42/94
2,763,456 A * 9/1956 Breer ..... F16M 11/28 248/186.1
2,844,905 A * 7/1958 Walton ..... F41A 23/06 42/94
3,235,997 A * 2/1966 Stoner ..... F41A 23/08 42/94
3,445,082 A * 5/1969 Frazer ..... F41A 23/08 248/183.3
3,632,073 A * 1/1972 Nakatani ..... F16M 11/14 248/169
4,121,799 A * 10/1978 Michio ..... F16M 11/14 248/171
4,215,839 A * 8/1980 Gibran ..... F16M 11/16 248/170
4,351,224 A * 9/1982 Curtis ..... F41A 23/08 42/94
4,545,660 A * 10/1985 Rudolf ..... F16M 13/00 248/171
4,625,620 A * 12/1986 Harris ..... F41A 23/08 42/94
4,844,390 A * 7/1989 Duke ..... F16M 13/04 248/118
5,029,407 A * 7/1991 Kirkpatrick ..... F41A 23/10 42/94
5,074,188 A * 12/1991 Harris ..... F41A 23/08 42/94
5,081,782 A * 1/1992 Wright ..... F41A 23/16 42/94
5,222,705 A * 6/1993 Gibran ..... F16M 11/04 248/170
5,345,706 A * 9/1994 Brown ..... F41A 23/06 42/94
5,384,609 A * 1/1995 Ogawa ..... F16M 11/28 396/419
5,438,786 A * 8/1995 Hilderbrand ..... F41A 23/14 248/171
5,593,239 A * 1/1997 Sallee ..... E04H 12/182 135/114
5,711,103 A 1/1998 Keng
5,937,560 A * 8/1999 Beltz ..... F41C 23/02 42/94
6,289,622 B1 * 9/2001 Desch, Jr. ..... F41A 23/10 42/94
6,305,116 B1 * 10/2001 Parker ..... F41A 23/04 42/94
6,539,660 B1 * 4/2003 Yeargin ..... F41A 23/10 42/94
6,763,627 B1 7/2004 Kaempe
7,356,960 B1 4/2008 Knitt
7,614,174 B1 11/2009 Beltz
7,676,977 B1 3/2010 Cahill et al.
7,779,572 B2 8/2010 Potterfield et al.
7,793,454 B1 * 9/2010 Beltz ..... F41A 23/10 42/72
7,954,272 B2 6/2011 Potterfield et al.
8,291,633 B1 10/2012 Hass et al.
8,327,570 B2 12/2012 Potterfield et al.
8,418,394 B2 * 4/2013 Keng ..... F41A 23/10 248/163.2
9,303,940 B2 * 4/2016 Bonelli ..... F16M 11/14
10,012,465 B1 7/2018 Liechty
10,295,292 B2 * 5/2019 Ding ..... F41A 23/02
2005/0188588 A1 * 9/2005 Keng ..... F41A 23/10 42/72
2005/0188597 A1 * 9/2005 Keng ..... F41A 23/08 42/94
2005/0207749 A1 * 9/2005 Barker ..... F16M 11/14 396/428
2005/0241206 A1 * 11/2005 Teetzel ..... F41A 23/08 42/72
2005/0242250 A1 * 11/2005 Keng ..... F16M 11/10 248/168
2006/0278797 A1 12/2006 Keng et al.
2008/0052979 A1 * 3/2008 Lee ..... F41A 23/04 42/94
2009/0064559 A1 3/2009 Potterfield et al.
2009/0126250 A1 5/2009 Keng
2012/0272557 A1 * 11/2012 Yan ..... F41C 23/12 42/69.01
2014/0115940 A1 5/2014 Bonelli et al.
2014/0259849 A1 * 9/2014 Jakele ..... F41C 23/20 42/74
2016/0265864 A1 * 9/2016 Poling ..... F41A 23/10
2016/0273863 A1 9/2016 Hayes
2017/0205180 A1 7/2017 Ding et al.
2018/0202746 A1 * 7/2018 Flood, Jr. ..... F41A 23/10
2018/0259287 A1 * 9/2018 Palu ..... F41A 23/10
2019/0041156 A1 2/2019 Beachli et al.
2019/0063861 A1 2/2019 Gyurec
2019/0072355 A1 3/2019 Pop
2019/0293378 A1 * 9/2019 Flood, Jr. ..... F41A 23/10

OTHER PUBLICATIONS

LaRue Tactical Atlas Bipod downloaded on Feb. 5, 2018 from https://www.larue.com/products/atlas-bipod-bt10-nc-and-lt271-qd-mount-combo/.

Indexing Plate downloaded Feb. 5, 2018 from https://www.bing.com/images/search?view=detailV2&ccid=%2f6CjUUIH&id=F53790632ACA30D92DB133F9F31EBEE161B47EB0&thid=OIP._6CjUUIHi42FZWCWA2WXPQHaln&mediaurl=https%3a%2f%2fwww.flotron.com%2fwp-content%2fuploads%2f2014%2f12%2fIND15_1018.gif&exph=663&expw=570&q=ind15+index+plate+1018+mounting+plate&simid=607995938326120489&selectedIndex=0&ajaxhist=0.

CTK Precision AI Monopod Instructions viewed Jul. 12, 2018 and downloaded from http://www.ctkprecision.com/instructions_accuracy-international-monopod.aspx.

Harris 1A2-LM Bipod Leg Notch Sling Swivel Stud Mount 9" to 13" Black downloaded Jan. 4, 2019 from https://ads.midwayusa.com/product/586996/harris-1a2-lm-bipod-leg-notch-sling-swivel-stud-mount-9-to-13-black?utm_medium=shopping&utm_source=bing&utm_campaign=Shooting+-+Rests%2C+Bi-Pods+%26+Benches&utm_content=586996&cm_mmc=pf_ci_bing-_-Shooting+-+Rests%2C+Bi-Pods+%26+Benches-_-Harris+Bipods-_-586996&msclkid=3873f85d61af15f0b2b4a472e2bfef8e&utm_term=4585513244644284.

GG&G XDS Heavy Duty Bipod Picatinny Rail Mount 8" to 10.5" Aluminum Black downloaded Jan. 4, 2019 from https://ads.midwayusa.com/product/316189/gg-and-g-xds-heavy-duty-bipod-picatinny-rail-mount-8-to-105-aluminum-black.

Versa-Pod Model 52 Prone Bipod Sling Swivel Stud Mount 9" to 12" Black downloaded Jan. 4, 2019 from https://www.midwayusa.com/product/1015342267/versa-pod-model-52-prone-bipod-sling-swivel-stud-mount-9-to-12-black.

Sierra 7 Bipod downloaded Jan. 4, 2019 from http://s7bipod.com/.

APO LRA Bipod F-Class Competition downloaded Jan. 4, 2019 from https://www.bing.com/images/search?view=detailV2&ccid=NCAH0jHz&id=02B5AF02FB935222E20C6FF8A99FDC8B5DB38490&thid=OIP.NCAH0jHzWUaZkYY8-RqoDwHaHa&mediaurl=http%3a%2f%2fconfigio.blob.core.windows.net%2fmedia% 2fem_ashbury%2fUploadedImages%2fLarge%2fProduct_544.png&exph=640&expw=640&q=apo+lra+bipod+f-class+competition&simid=608017984360549515&selectedIndex=0&ajaxhist=0.

(56) References Cited

OTHER PUBLICATIONS

CTK Precision Ultimate Rail-Pod downloaded Jan. 4, 2019 from http://www.ctkprecision.com/ultimate-rail-pod.aspx.
AccuShot B146-LW17 PSR Atlas Bipod with ADM-170-S downloaded Jan. 4, 2019 from https://www.amazon.com/Genuine-AccuShot-Atlas-Bipod-BT46-LW17/dp/B00R3OQQ7W.

* cited by examiner

FIREARM SUPPORT AND RELATED METHOD OF USE

BACKGROUND OF THE INVENTION

The present invention relates to weapons, and more particularly to a weapon accessory that can support a weapon in a firing or other position.

When firing a weapon at a target, it is usually helpful to have the weapon stabilized and unmoving to ensure proper target acquisition, aiming and shot placement. There is a variety of supports available to fulfill this function. A popular support for small arms is the bipod. A bipod typically attaches to the front handguard or stock of a firearm or other small arm, and projects downwardly therefrom. A bipod usually includes two spring-loaded legs that deploy from a transport position to a deployed position, in which they are ready to support the firearm during fire.

Many bipods are adjustable in height to enable a user to raise or lower the barrel of the rifle and precisely aim or fire it at a target, particularly one at a long distance. Most conventional bipods utilize a system of horizontal, parallel, circumferential notches one above the other along a leg. These notches are selectively engaged by a latch and/or screw to secure the leg at a particular length, and thus set the bipod and weapon at a particular elevation for aiming and firing at a target.

While this design works in many situations, it has several shortcomings. For example, this type of design frequently requires two hands to set up properly. Specifically, a user will release the latch or turn the screw with one hand, then, with the other hand, will pull on or push the leg to finely adjust its length. From there, the user will reengage the latch or screw, grip the weapon with both hands and see how well the adjustment fared in aligning the weapon sights with the target. Frequently, further adjustment of the pod will be necessary because the first adjustment was insufficient. The user must then repeat the steps above with both hands. The use of both hands to finely adjust the height of most conventional bipods negates a shooter's ability to hold the weapon against their shoulder with one hand to view their sights and see how much adjustment is needed or has been made to properly aim the weapon at the target. This can be tedious, and can reduce the readiness of the user firing of the weapon.

In addition, many conventional bipods are held in an extended or fixed state length via the interlocking of a tooth within a notch. Sometimes, bipods are used in formidable environments and put under significant forces, for example, when a user pushes their weight forward against the weapon, and thus the bipod, to enhance stability. Under such stresses and due to impact with objects, the tooth can disengage the notch and can cause the leg to shorten in length inadvertently and unexpectedly. This can cause uncertainty, chaos or danger if it occurs while a shot is taken.

Accordingly, there remains room for improvement in the field of support pods to support weapons in a firing position.

SUMMARY OF THE INVENTION

A support pod configured to support a weapon in a firing position includes a support tube and leg telescopingly joined with one another. The leg can include a longitudinal axis. A lock portion can define grooves downwardly angled relative to the axis; and a guide portion can define recesses downwardly angled relative to the axis. The recesses can be distal and separate from the grooves, and both optionally can be downwardly spiraling at a preselected angle.

In one embodiment, the lock portion and guide portion can be included on the leg. The lock element can move into and out from a groove. A guide element can move into and out from a recess when the lock element moves into and out from a groove. The leg can be operable in a locked mode, in which the lock element can be in a first groove and the guide element can be in a first recess, to set an overall length of the pod. The leg can operate in an adjustment mode in which the lock element and guide element can transition out from their respective groove and recess, and can move up or down to other vertically displaced respective grooves and recesses chosen by a user to set the pod at a new overall length to adjust the height at which a weapon is supported by the pod.

In another embodiment, the leg can be locked in place by the lock element engaging a particular groove, while the guide element rests in and engages a particular recess to set the overall length of the pod. The lock element optionally can be pressed into the particular groove with a lock ring. The lock ring can be manually operable so that the lock element can be released and no longer pressed as forcibly into the groove, such that it can move relative to the groove.

In still another embodiment, the grooves and recesses can be downwardly spiraling at a predetermined angle relative to the longitudinal axis of the leg. This angle optionally can be at least 40°, at least 45°, between 40° and 50°, inclusive between 45° and 65°, inclusive or less than 90°. This predetermined angle can assist in ensuring that the guide element settles in a particularly chosen recess so that the guide element cannot move out of it under the force of gravity when the pod is normally set up. The angles for both the recesses and the grooves optionally can be equal.

In yet another, embodiment, the recesses and grooves can be of a predetermined length so that the guide element and lock element transition substantially out from the same upon rotation of the leg about the longitudinal axis by a predetermined rotational angle. That rotational angle optionally can be about 90°, between 80° and 100°, inclusive, less than 90° or less than 100°.

In even another embodiment, the support tube can include an upper end attached to a base, a lower end, an interior and an exterior. The leg can be telescopingly positioned in the interior of the tube, and can move into and out from the lower end of the tube. The leg can be biased to retract into the tube with a bias element, such as a spring, so that the leg is normally retracted at least partially in the tube. The bias force of the spring can be countered by a user applying a downward force on the leg to extend the leg from the tube.

In another, further embodiment, the lock ring can be rotatably mounted to the support tube and placed for selective engagement with the lock element. The lock element can be journalled in a lock aperture, and can project into a recess defined by the lock ring. The lock ring can include a ramped surface inside the recess that engages the lock element. By rotating the lock ring, a user can engage the ramped surface against the lock element with more or less force, which in turn can press the lock element into a portion of a groove and further lock the leg relative to the support tube.

In a further embodiment, the lock element can be pressed with the lock ring into a deep portion of a groove in a locked mode so that the lock element is substantially engaged with the groove, effectively locking the leg and support tube in a preselected orientation relative to one another, thereby setting the overall length of the support pod.

In still a further embodiment, the support pod can be in the form of a monopod, a bipod, a tripod, a quad pod or other types of support structures configured to support a weapon in a firing position. The respective pods can include a corresponding number of legs and support structures as described herein.

In yet a further embodiment, the support pod can include a base. The base can include an engagement surface configured to engage a portion of a weapon. In some cases, the base can secure to a weapon, and in others, it can be configured so that a weapon can rest on the engagement surface temporarily, and can be easily lifted and removed therefrom, thereby operating primarily as shooting sticks, rather than a bipod secured to the weapon.

In even a further embodiment, a method of using a support pod to orient a weapon in a firing configuration is provided. The method can include engaging a base adjacent a weapon; projecting the support tube and the leg away from the base; rotating the support tube and leg relative to one another in a first direction to transition the leg from a first locked mode, in which a guide element is disposed in a first recess that is downwardly angled relative to a longitudinal axis of the leg, and in which a lock element is disposed in a first groove that is downwardly angled relative to the longitudinal axis of the leg, to a first adjustment mode, in which the lock element is removed from the first groove and the guide element is removed from the first recess; moving the support tube and the leg in a telescoping manner relative to one another to at least one of increase and decrease an overall length of the support pod; and rotating the support tube and leg relative to one another in a second direction to transition the leg from the first adjustment mode to a second locked mode. A user can thus adjust the overall length and thereby orient the weapon supported on the support pod in a predetermined configuration to fire the weapon at a target.

In another, further embodiment, the method can include rotating the leg in opposite direction to configure the leg in the locked mode or the adjustment mode. In the second locked mode, the guide element can be disposed in a second recess that is downwardly angled relative to the longitudinal axis of the leg, and in which the lock element is disposed in a second groove that is downwardly angled relative to the longitudinal axis of the leg. The second groove and recess can be above or below the respective first groove and recess.

In still another, further embodiment, the method can include rotating the lock ring about the longitudinal axis so that the lock element rides along the ramped surface of the lock ring, before the rotating the support tube and leg relative to one another, so that the lock element can be unlocked relative to the first groove.

The current embodiments of the support pod and method of use provide benefits related to weapon supports that previously have been unachievable. For example, with the present support pod, a user can quickly and precisely unlock, adjust and relock a pod with one hand. Accordingly, the user can still use their other hand to maintain the weapon in a ready position and/or check alignment of their sights with a target while adjusting the barrel of the weapon with the support pod via their other hand. This can increase firing readiness, aiming and shot placement times. The downward angle of the guide recesses and the lock grooves also can ensure that the guide element and lock element will naturally come to rest at a lowermost part of those recesses and grooves if the lock becomes disengaged and the force of gravity pushes the support tube downward over the leg. Thus, the leg and support tube will not erratically or inadvertently collapse relative to one another, even when the lock element is not properly engaged or fails. Where included, the lock ring only needs a simple, one-handed twist motion to unlock and lock the lock element quickly and easily.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
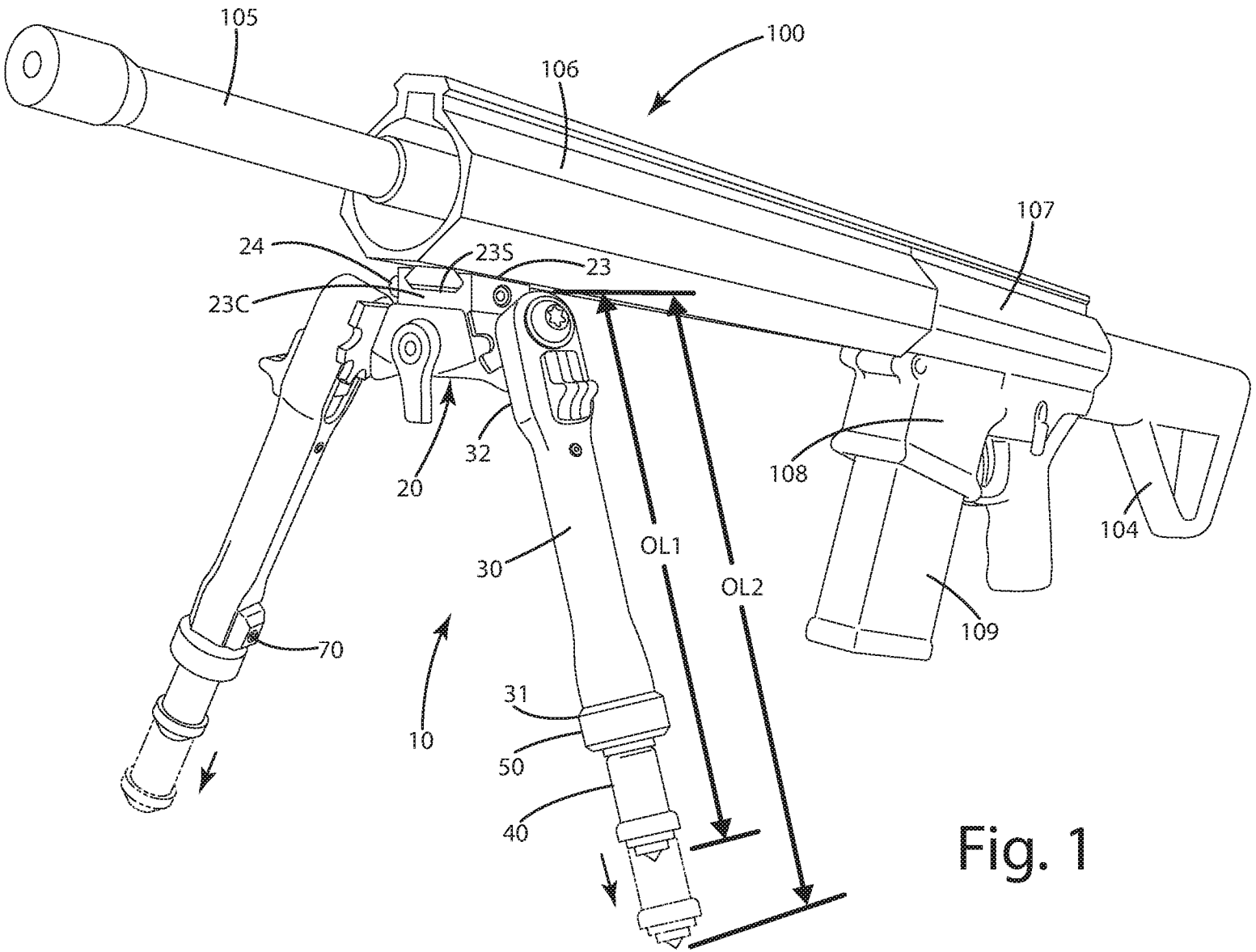
FIG. 1 is a perspective view of the support pod of a current embodiment in the form of a bipod in a locked mode mounted on a firearm.

A current embodiment of a support pod for a weapon is illustrated in FIGS. 1-14 and generally designated 10. The support pod is configured to be mounted to any weapon that is fired at a target. As shown, the support pod 10 includes a base 20 that is configured to engage a surface of a weapon, for example a handguard of a weapon 100. The weapon 100 illustrated is in the form of a small arm, such as an AR-15 firearm, but of course can be any other type of weapon, including but limited to small arms, such as rifles, pistols, handguns, shotguns, of any firing capability, automatic or semiautomatic or single shot; archery bows, such as cross bows; paint markers, also known as paint ball guns, airsoft guns, BB guns, pellet guns and any other weapon capable of firing a projectile at a target. As shown, the exemplary firearm 100 can include a stock 104 configured to shoulder against a user, a barrel 105, a handguard 106, an upper receiver 107 and a lower receiver 108, which is configured to receive a removable magazine 109.

The support pod 10 as shown can be in the form of a bipod, having two supports extending downward from the firearm to support it. However, the support pod can be implemented in other pod configurations, such as monopods, tripods, quad-pods or any multi-leg pod configuration depending on the weapon application. In the current embodiment, only one support pod of the bipod will be described. As shown, the pod 10 can include the base 20 having an engagement surface 23 that can be configured to engage against a surface of the weapon. That surface can be a portion of a stock, a part of a handrail, or some other part of the weapon. The base can include an attachment clamp 23C that includes a slot 23S within which a picatinny rail or other projection or surface of the weapon can fit. The clamp 23C can include a fastener 24 that can be tightened to secure the support pod 10 to the weapon 100. Optionally, in cases where the support pod 20 is configured to not be mounted directly to the weapon, the base can be in the form of a V or U-shape at its top, so that a weapon can rest on or in that structure to provide support while readying the weapon for firing.

Optionally, as shown in FIGS. 1 and 12-14, the base 20 optionally can include one or more support flanges 20SF. These support flanges can be joined with a support tube 30 via a support tube fastener 24F, as described below, to provide angular adjustment to the support pod.

With reference to FIGS. 1-4, the support pod 10 can include a support tube 30 and a leg 40 that are telescopingly joined with one another. The support tube 30 can extend outwardly and downwardly from the base 20. The support tube 30 can include an exterior 30E and an interior 30I. The exterior 30E can be contoured to include various surfaces as shown. Of course, the exterior alternatively can be substantially cylindrical or can have other geometric configurations depending on the application. The interior 30I can form a cavity or compartment within the support tube 30. The leg 40 can be telescopingly disposed in the interior 30I of the support tube 30. A substantial portion of the length L1 of the leg can be disposed in the interior of the support tube 30. The support tube 30 can include a first end 31 and a second end 32. The second end 32 can be joined with the base 20, which can include different components and features to adjust the angle of the support tube and leg, and generally the support pod 10, relative to the base 20 as described below. The first end 31 of the tube can be an open end through which the leg 40 projects outward from the interior 30I. The first end 31 of the support tube 30 can include a locking ring 50 as described further below. The first end 31 also can include a lock element 60 and a guide element 70 adjacent it.

The guide element 70 can be in the form of a fastener, for example, a set screw. The fastener 70 can be accessible from the exterior 30E of the support tube 30 and can project inwardly toward the support leg 40, into an interior 30I of the support tube 30. The guide element 70 can include a guide element axis GA that is generally orthogonal or perpendicular to the longitudinal axis LA of the leg 40. The lock element 60 optionally can include a threaded portion 70T and an engagement portion or distal end 73, which can project into the interior 30I of the tube 30. This engagement portion 73 can be a distal tip of the fastener or this portion can be a rounded and/or cylindrical configuration as shown. Of course, in other applications, the engagement portion can be of varying geometric configurations and cross sections. Generally, with the engagement portion 73 being rounded, it can easily move and/or slide relative to at least one of the plurality of recesses 44R1-44R5 defined by the leg 40 as described below.

The guide element 70 can be a fastener including a drive, which can be tightened with a tool, such as a hex key. The guide element can further clamp the leg 40 within the interior 30I when the element 70 engages a portion of one or more recesses as described below. Of course, as shown, the guide element 70 optionally does not exert any type of clamping force against the leg. Instead, it can be threaded enough into the guide aperture 70H, which is also threaded, such that the engagement portion 73 simply moves in and/or slides freely relative to the one or more of the various recesses 44R.

Returning to FIGS. 3-4, the leg 40 can include a lock portion 42 and a guide portion 44. The lock portion 42 can define multiple grooves 42G1-42G5 which optionally can correspond to the multiple recesses 44R1-44R5. It is noted here that although the grooves and recesses are referred to using different words, that is, grooves and recesses, these elements can be similar if not identical in some applications. For example, although an element is referred to as a groove, it also can be referred to as a recess, a slot, an aperture, a hole, a passageway and/or a channel. Likewise, although an element is referred to as a recess, it also can be referred to as a groove, a slide, an aperture, a hole, a passageway and/or a channel. These grooves and recesses optionally are not in the form of simple threads, for example, those of a nut and bolt. Further, these recesses and grooves optionally are not contiguous or are discontinuous with one another, that is, they are isolated from one another and do not run into or transition to one another. Regardless of their names, the respective recesses 44R1-44R5 are configured to interact and interface with the respective guide element 70, whereas the respective grooves 42G1-42G5 are configured to interact and interface with the respective lock element 60 as described below.

The lock portion 42 and guide portion 44 of the leg 40 can be disposed on opposite sides of the leg, optionally offset from one another by about 180°. The leg 40 itself can be constructed as elongated member having the respective lock portion and guide portion. The leg optionally can be in the form of a cylinder, having an outer cylindrical surface 41E. This outer cylindrical surface 41E can define the respective recesses and grooves, which can extend inwardly from the exterior surface 41E toward the longitudinal axis LA.

Figure 3:
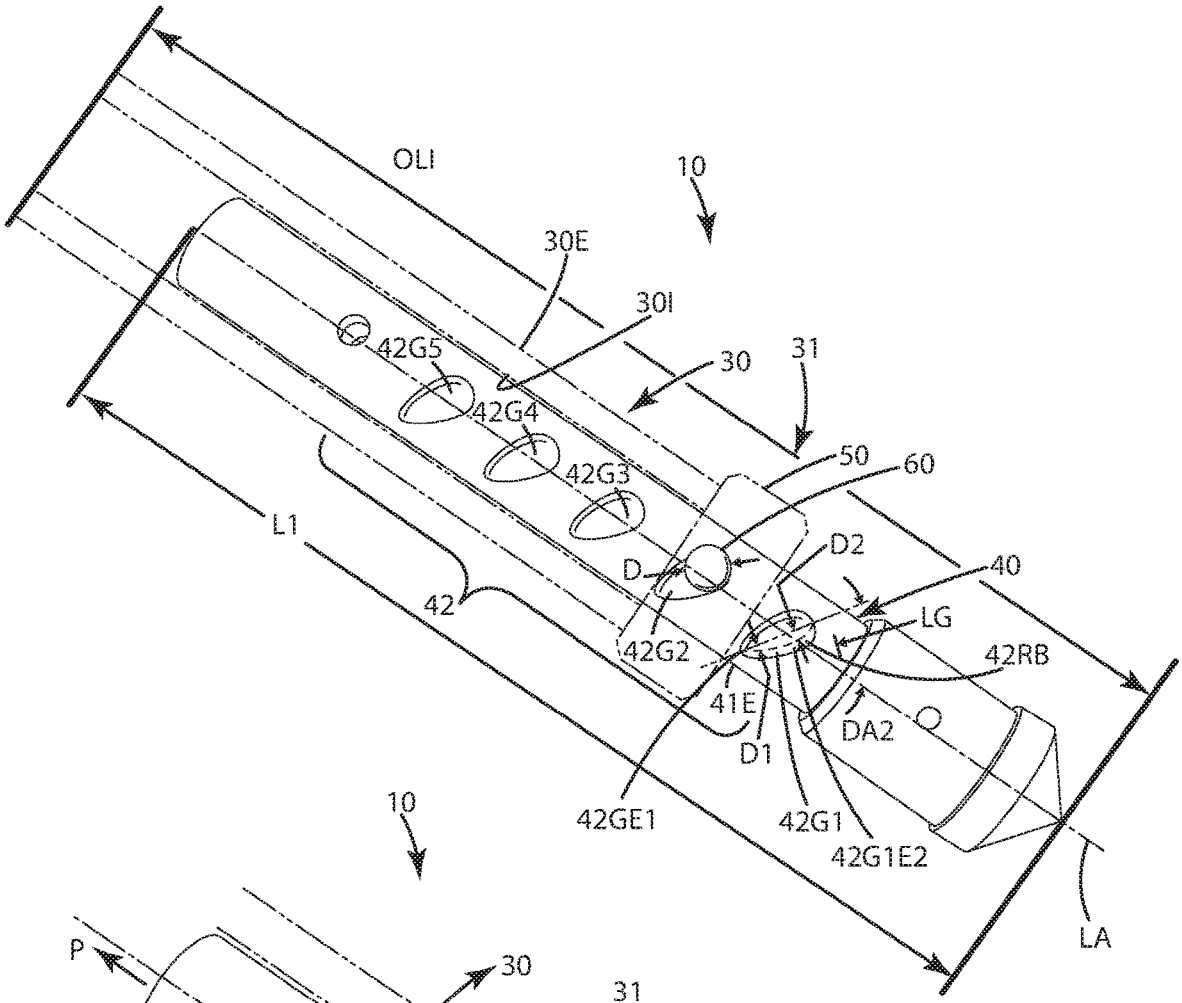
FIG. 3 is a partial section view of the support pod in the locked mode, with the lock element in a deep and lower portion of a particular groove, in a locking portion of the leg.

The recesses and grooves can be downwardly angled relative to the longitudinal axis LA of the leg 40. For example, as shown in FIG. 3, the grooves, such as exemplary groove 44G1 can be downwardly angled or offset relative to the longitudinal axis LA by the downward angle DA2. This downward angle DA2 optionally can be at least 40°, at least 45°, between 40 and 50° inclusive, between 45 and 65° inclusive, less than 90° or about 45°.

Figure 4:
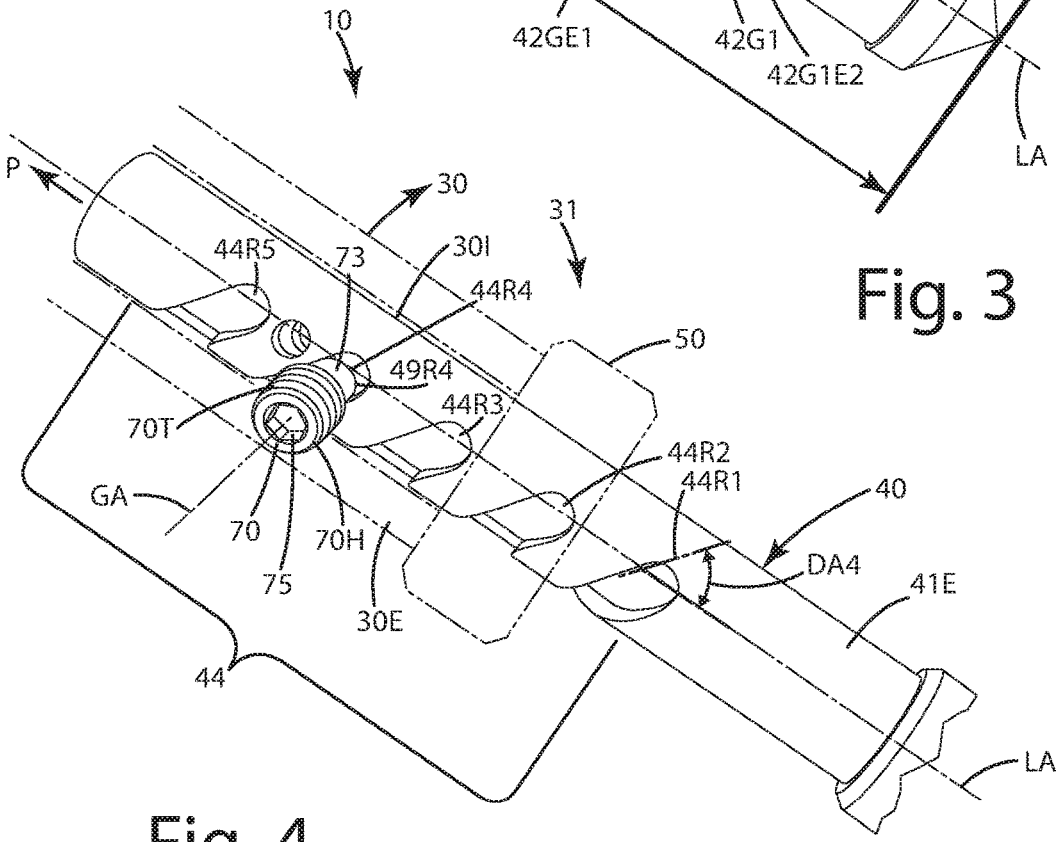
FIG. 4 is a partial section view of the support pod in the locked mode, with the guide element in a lower portion of a particular recess, in a guide portion of the leg.

As shown in FIG. 4, the recesses, such as exemplary recess 44G1 can be downwardly angled or offset relative to the longitudinal axis LA by the downward angle DA4. This downward angle DA2 optionally can be at least 40°, at least 45°, between 40 and 50° inclusive, between 45 and 65° inclusive, less than 90° or about 45°. Where the angles DA4 and DA2 optionally are equal, the respective guide element 70 and lock element 60 can easily enter the respective recesses and grooves when the leg 40 is turned relative to the support tube 30 as described below. These downward angles also can assist in ensuring that the guide element settles in the particularly chosen recess so that the guide element cannot move out of that recess under the force of gravity when the pod is normally set up.

Optionally, the recesses and grooves can spiral downwardly about the longitudinal axis LA of the leg 40. Although not in the form of a thread, these grooves and recesses can twist around that longitudinal axis LA in a generally helical configuration. The particular twist and rate of turn of the downward spiral can vary depending on the application. Optionally, a spiral can include the downward angle DA2 and DA4 as described above. Further optionally, the grooves and/or recesses can spiral around the longitudinal axis LA optionally less than 180°; optionally between 45° and 180°, inclusive; further optionally between 45° and 120°, inclusive.

The grooves that interface with the lock element and the recesses that interact with the guide element can be of different configurations. For example, the grooves can each include increasing groove depth while the recesses can be of a constant or uniform depth. Referring to FIG. 3 an exemplary groove 42G1 can have a rounded bottom 42RB. This rounded bottom 42RB can optionally mimic or reflect the rounded or spherical configuration of the lock element 60, which as shown can be in the form of a bearing or spherical element. The rounded bottom 42RB can become shallower and can transition to the substantially cylindrical exterior surface 41E of the leg.

The groove 42G can be of an increasing depth. For example, in transitioning from the entrance end 42G1E1 to the opposite end 42G1E2, the depth of the groove can increase from a depth D1 to a greater depth D2. Depth D1 can be less than the depth D2. In some cases, the depth D1 can be less than a 1/10 of diameter D of the lock element 60, whereas the depth D2 can be greater than 1/10 of diameter D of the lock element 60. In other cases, the depth D1 optionally can be less than one-quarter diameter D, less than one-half diameter D, or less than diameter D. The depth D2 optionally can be less than one-half diameter D, less than three quarter D or less than D. Further optionally, the depth of the groove can increase in transitioning from the depth D1 to the depth D2. Further optionally, the depth D2 can be the deepest depth of the groove along the length LG of the groove. In some applications, the depths D1:D2 can be in a particular ratio; such as optionally: at least 100:1, at least 10:1, at least 5:1, or at least 2:1.

As shown, the bottoms of the grooves can be rounded, for example, of a parabolic and/or partially circular configuration. Of course, in other constructions, the bottom 42RB can be angled, that is, square, triangular, boxed, or of other geometric configurations. At the end 42G1E1 of the groove 42G1, the groove can go to a zero depth and can transition to the smooth outer cylindrical surface 41E of the leg 40.

Figure 7:
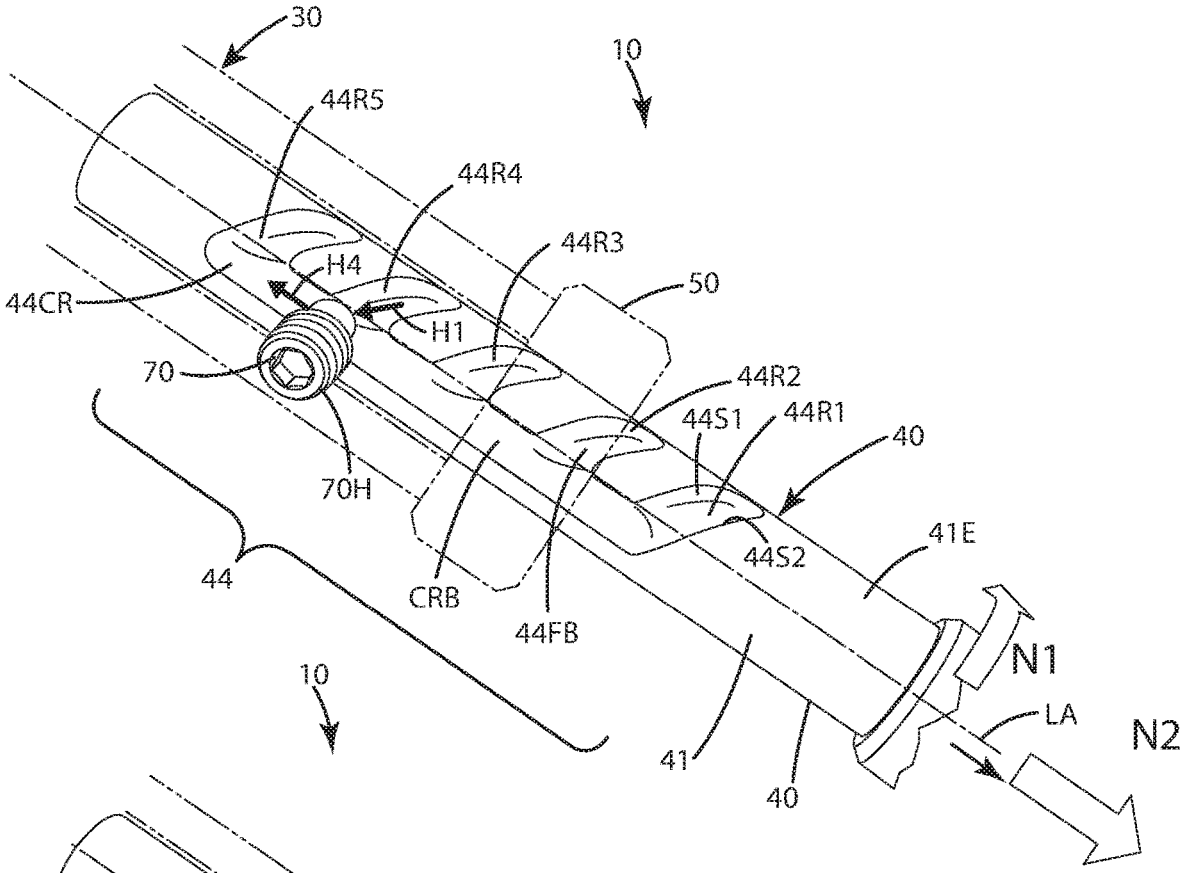
FIG. 7 is a side view of the leg being rotated in a first direction to transition the guide element out of a first recess in guide portion of the leg, to transition the leg to an adjustment mode.

The recesses, shown in FIGS. 4 and 7, can be of a slightly different configuration than the grooves. For example, as shown in FIG. 7, the exemplary groove 44R1 can include a flat bottom 44FB that transitions to generally perpendicular sides 44S1 and 44S2. Taking the cross section of the groove 44R1 at a plane with which the longitudinal axis is coincident, the recess 44R1 can be of a rectangular, boxed, triangular or generally channel shaped. The bottom of the recess can be generally angled, having a rectangular shape, a box shape or other polygon shape. Optionally, each of the recesses 44R1-44R5 can be of a constant, uniform depth as they angle and/or spiral downward.

Further optionally, each of the recesses can join with or can otherwise be in communication with secondary common recess 44CR. Each of the recesses can be of a substantially constant depth, even at the location where they open to or join with the secondary common recess. The secondary common recess also can have a substantially constant depth, similar to the remainder of the recesses. The secondary common recess 44CR can include a bottom 44CRB that transitions to and is continuous with the respective bottoms 44FB of the respective recesses that open to the secondary common recess. This bottom 44CRB can form a neutral landing that is disposed adjacent the openings of the recesses defined by the leg. The neutral landing and the secondary recess can extend parallel to the longitudinal axis LA of the leg 40. The secondary common recess 44CR also can extend from the lowest recess 44R1 to the highest recess 44R5 such that all the recesses are in communication with and continuous with one another.

As described further below, the guide element 70, and in particular the engagement portion or distal tip 73, can extend and travel or otherwise move within and between the respective recesses and the secondary common recess when being adjusted from one mode to the next. As described below, the guide element can travel into and out from the respective recesses and into an out from the secondary common recess. Of course, in some applications, the secondary common recess can be eliminated, and the recesses can transition to a neutral landing, which can be or form a portion of the exterior 41E of the leg 40.

As mentioned above, and with reference to FIGS. 3 and 8, the pod 10 can include the lock element 60. This lock element optionally can be in the form of a spherical component, such as a bearing. The lock element can be constructed from any material, such as metal, plastic and/or composite. Typically it can be constructed from metal so that it can have high wear capabilities and is extremely durable. The lock element 60 can be configured to engage and/or roll in the respective grooves individually so as to hold and/or secure the leg in a particular relationship relative to the support tube as described below. Generally, when the leg is in a locked mode, the lock element 60 shown in FIG. 3 is in a deep portion of a particular groove. The lock element can be configured to move into and/or out from an increasing groove depth of a respective groove in which the lock element is disposed. Optionally, when the lock element is disposed in a deep portion of a respective groove, this corresponds to the guide element being disposed in a lowermost portion of a downward angled recess. This in turn can better lock and secure the tube relative to the leg so that the guide element can establish a particular overall length of the pod as described below.

Optionally, when the lock element 60 is in a spherical form, in transitioning into and out from the respective grooves, the lock element 60 can roll and/or partially slide relative to the groove and the exterior surface of the leg, depending on its location relative to the groove and the exterior surface.

The lock element 60 can be secured via a lock ring 50 relative to the leg and/or a particular groove. The lock ring 50, shown in FIGS. 2, 5, 5A, 6 and 6A, can be of an annular shape and can circumferentiate a portion of the support tube and/or the leg. The lock ring 50 can be secured to the tube in a rotatable manner. The lock ring 50 can be secured at the first end 31 of the support tube and can rotate relative to it. The lock ring 50 can include an actuator recess 52, which moves relative to the ball 60 when the ring 50 is rotated. The actuator recess 52 can include a ramped surface 53. The actuator recess 52 thus can be referred to as a ramped recess. The recess 52 can extend particularly around the longitudinal axis LA of the leg 40. The ramped recess can be bounded by a ramped wall 53W, which includes the ramped surface 53. This wall 53W can thicken from a first portion 54 to a second portion 55 of the wall. For example, the wall thickness T1 can increase to a greater thickness T2 in this transition from the first portion to the second portion. The lock element 60 can roll along or relative to this wall 53W and the ramped surface 53 when the lock ring 50 is rotated about the longitudinal axis LA.

Figure 5:
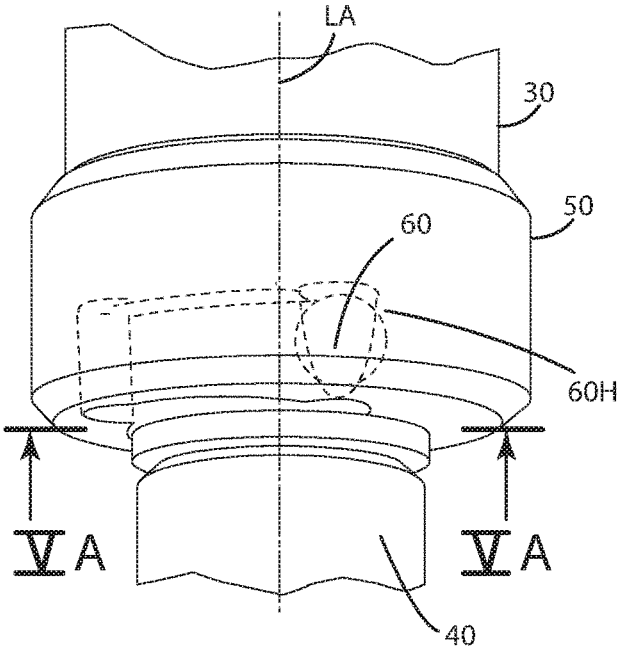
FIG. 5 is side view of a locking ring engaging the lock element of the support pod so that a ramped surface engages the lock element to retain the lock element in a deep portion of the groove and the leg in a locked mode.
Figure 5A:
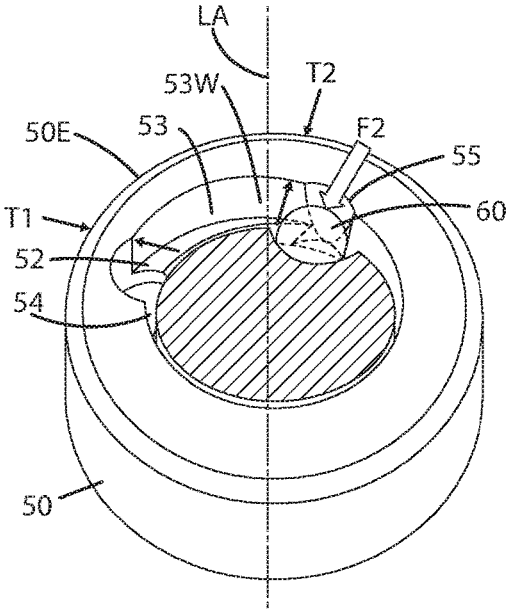
FIG. 5A is a partial section view thereof.

For example, when the lock ring 50 is rotated to the position shown in FIGS. 5 and 5A, the second portion 55 of the ramp recess 53 and wall 53W can engage the lock element 60. Because the wall 53W includes the thickness T2 in this area or region, the wall and ramped surface 53 pushes the lock element 60 downward under force F2, into the groove defined in the leg. The lock element can be pushed downward into the deeper portion of the respective groove, and can be prevented from rolling or otherwise moving relative thereto. The lock element also can engage the lock aperture 60H. The lock element can establish a lock or immovable element between the support tube and the leg so that the leg cannot be rotated relative to the support tube. In turn, this results in the leg and/or lock element achieving the secondary locked mode described below.

Figure 6:
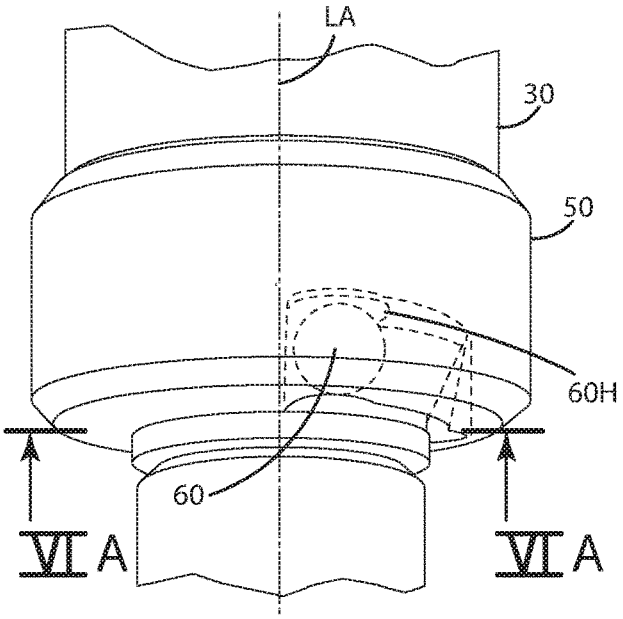
FIG. 6 is a side view of the locking ring after rotation such that the ramped surface engages the lock element less or not at all to allow the lock element to transition out from the respective groove, to an adjustment mode.
Figure 6A:
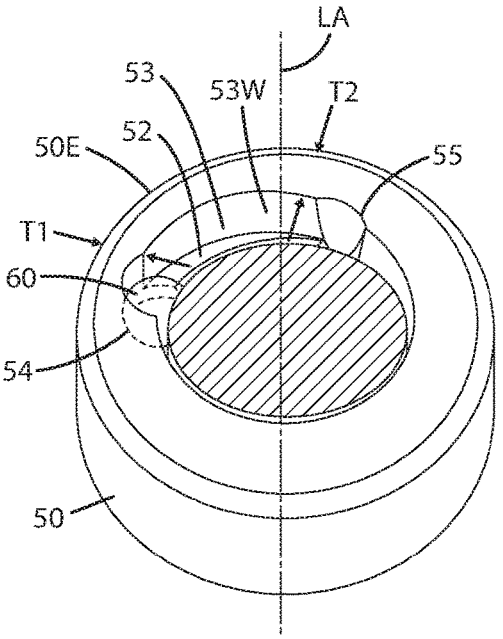
FIG. 6A is a partial section view thereof.

When the lock ring is rotated to the position shown in FIG. 6, lock element rolls relative to the ramped surface 53 and in the ramped recess 52 in general. Eventually the first portion 54 of the ramped recess 52 and ramped surface 53 engages the lock element 60. Because the wall 53W here includes the thickness T1 in this area or region, the wall and ramped surface 53 is moved away from the lock element 60 as the locking ring rotates, so that the lock element 60 is no longer compressed downward into the groove defined by the leg. The lock element 60 therefore is no longer prevented or impaired from rolling or otherwise moving relative to the corresponding groove within which it rests. In turn, the lock element no longer establishes a secondary lock or immovable element between the support tube and the leg. The lock element is free to roll in the lock aperture and relative to the groove. Thus, the leg can be rotated relative to the support tube. In turn, the leg 40 can be adjusted as described below.

The locking ring 50 can be rotated in different directions so as to alter the portion of the ramp recess and that ramped surface engages the lock element 60 and thus the level of engagement between lock element and a respective groove and/or surface of the leg. Of course, other mechanical structures can replace the locking ring so as to push, compress or otherwise move the lock element 60 into a respective groove of the locking portion 42 of the leg 40.

Figure 2:
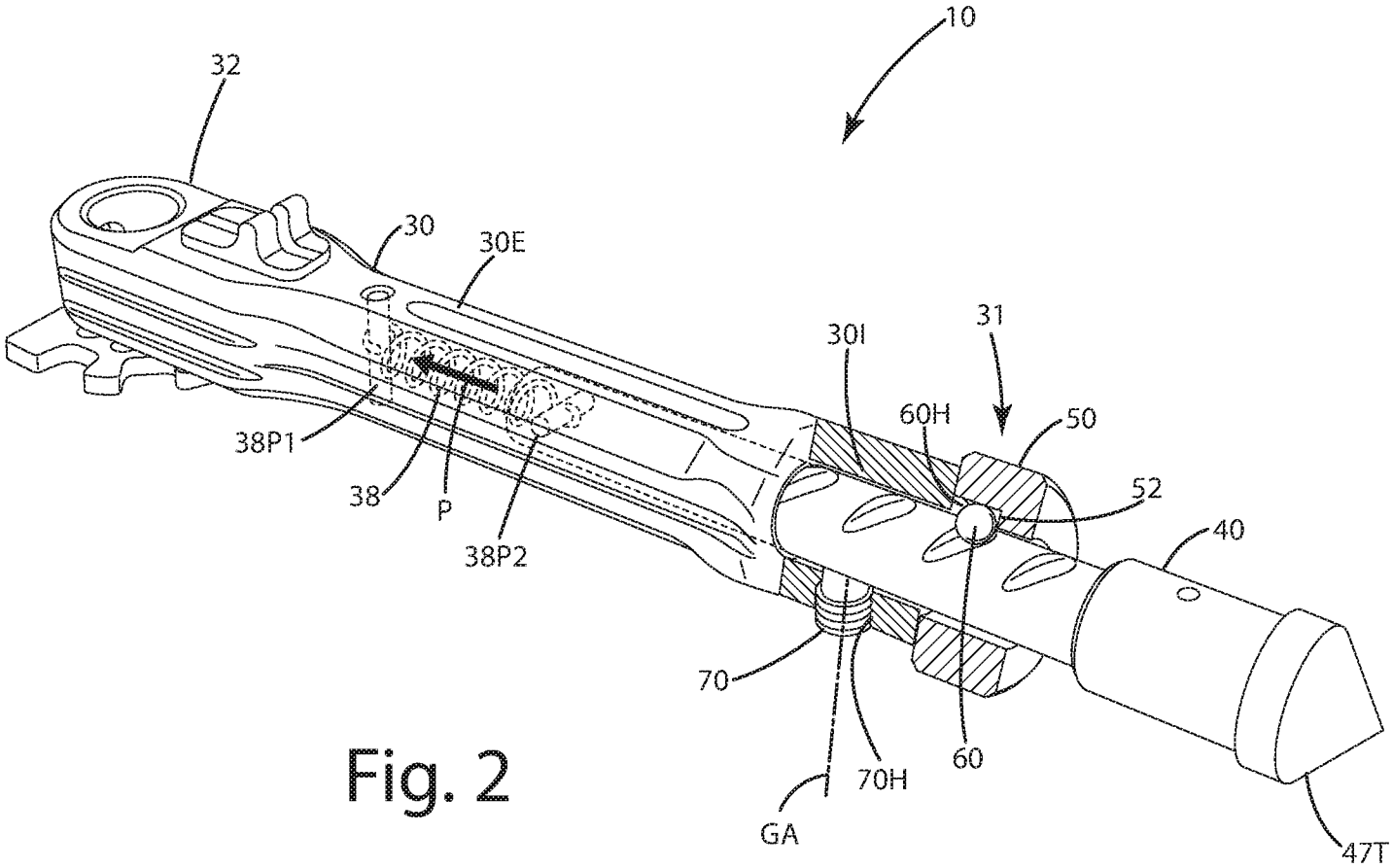
FIG. 2 is a partial section view of the support pod in the locked mode, with a lock element engaging a groove and a guide element engaging a recess defined by a leg of the support pod.

As shown in FIGS. 1 and 2, the leg 40 can be tipped with a leg tip 47T. The leg tip can be removable and/or replaceable relative to the remainder of the leg 40 to provide different types of gripping structures. For example, the tip 47T can be constructed from rubber or an elastomeric compound to provide padding and grip to the leg and thus the pod 10. Alternatively, although not shown, the tip 47T can be replaced with a multi-pointed claw or spikes, constructed from metal so that the points of the same can project into objects located under the pod and the weapon to provide extra grip and securement.

As mentioned above, the leg 40 can be telescopingly disposed in the interior 30I of the support tube 30. The leg 40 can be biased such that it is pulled under a force P into the interior of the support tube 30. For example, the pod 10 can include a spring 38 that is secured to a pin 38P1 which is further secured to the support tube 30 above the uppermost portion of the leg. The other end of the spring 38 can be secured with a pin 38P2 to the leg 40. The spring optionally can be a coil spring. The spring can exert the pulling force P on the leg to pull it upward and into the interior 30I of the support tube.

It will be noted here that under this pulling force P, when the leg is drawn up into the interior of the support tube, the recesses 44R1-44R5 of the leg are naturally guided along the guide element 70, particularly when the locking ring is loose and the lock element 60 does not engage a respective groove in a secondary locked mode. When the leg 40 is pulled upward under force P as shown, the edges of the recess 44R4 will ride along the tip or engagement portion 73 of the guide element 70. As this occurs, the pulling force P can rotate the leg (assuming it is not locked with the locking ring), in which case, the engagement portion 73 eventually bottoms out in the lowest portion 49R4 of the recess 44R4. Of course, on the opposite side of the leg, the lock element 60 also can have a tendency to migrate to the deepest portion of the groove 42G1. This natural movement of the guide element relative the recesses and the lock element relative to the grooves can be attributable to the downward angle and/or downward spiral configuration of the recesses and the grooves, and the way the guide element and lock element ride within them.

A method of using the support pod 10 to orient a weapon will now be described. As mentioned above, the support pod 10 optionally can be in the form of a bipod that supports a weapon 100 in a firing position, for example as shown in FIG. 1. In general, a user can use the bipod to set the elevation of the barrel of the weapon to fire at a target. The support pod 10 can be adjusted in its overall length, for example from a first overall length OL1 to a second overall length OL2. The support pod 10 and its leg also can be transitioned from a locked mode to an adjustment mode and back to a locked mode in making this adjustment. With reference to FIGS. 1 and 2, the support tube 30 and leg 40 can be projected away from the base 20. The leg 40 initially can be in a locked mode. Further, the locking ring 50 can engage a ramped surface 53 of a wall 53W against the lock element 60. As a result, this lock element 60 projects into and forcibly engages a groove 42G2. Due to the interaction of the ramped surface or wall against the lock element against the groove defined by the leg, the leg and/or locking ring is in a secondary locked mode and the leg is immovable, that is, it generally cannot be extended or retracted relative to the support tube 30.

Due to the configuration of the leg, the guide element 70 also is disposed in a corresponding recess, for example recess 44R4. The guide element distal tip or engagement portion 73 can be disposed in a lowermost portion 49R4 of this recess. In this configuration, the support pod 10 is generally locked in the first overall length OL1.

To convert the pod and leg from a locked mode to an adjustment mode, such that the leg 40 is movable or slidable relative to the support tube 30, and the overall length first overall length OL1 can be converted or adjusted to a second overall length OL2, the lock element can be removed from a portion of the groove 42G2. As part of this conversion, where included, the locking ring 50 and leg 40 in general can be transitioned out of the secondary locking mode. To do so, a user can grasp the lock ring 50 as shown in FIG. 5 and rotate the lock ring in direction M1. This in turn converts and moves the lock ring relative to the lock element 60 to the configuration shown in FIG. 6. Upon such rotation, the ramped surface 53 rides along the lock element 60 and becomes less engaged with that lock element. Optionally, the lock element 60 moves and optionally rolls relative to the ramped recess 62. Thus, the lock element is not as forcibly pushed into the respective groove 42G2. As a result, the lock element 60 can roll or move relative to that groove.

Figure 8:
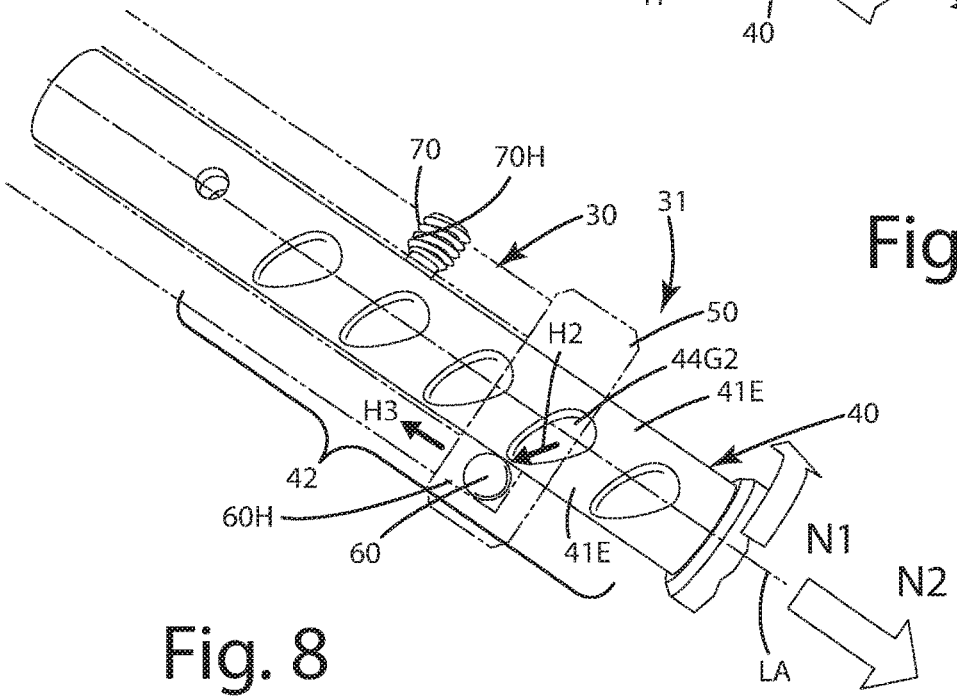
FIG. 8 is a side view of the leg being rotated in the first direction to transition the lock element out of the first groove in the locking portion, to transition the leg to the adjustment mode.

With the locking ring less engaged with the lock element, and out of the secondary locked mode, the lock element 60 can roll relative to the lock element aperture 60H. A user can then, with the same hand used to adjust the locking ring, rotate the leg 40 in direction N1 as shown in FIG. 7. When this occurs, the guide element 70 effectively moves out from the first recess 44R4 in direction H1 and transitions to the neutral landing and/or the secondary recess 44CR until it eventually enters that recess or is disposed over the neutral landing. As shown in FIG. 8, the lock element 60 also can roll in the first groove 44G2 until it exits that groove's opening and engages the exterior surface 41E of the leg 40. As this occurs, the lock element 60 remains constrained in the hole 60H defined by the support tube 30. The lock element 60 also moves out of the groove in the direction H2 upon such rotation of the leg in direction N1 relative to the support tube 30.

A user can then apply a force in direction N2. This force can overcome the force P on the leg exerted by the spring described above. As the force is applied and the leg moves in direction N2, the lock element 60 rides along the cylindrical surface 41E in direction H3 away from the first groove 44G2. The guide element 70 also moves in direction H4 away from the first recess 44R4 in the secondary recess and/or over the neutral landing, as the leg is pulled in direction N2 under the force. The leg 40 also moves telescopically relative to the support tube during this motion. During this motion, the leg also is operating in an adjustment mode in which the lock element is removed from the grooves and the guide element is removed from the recesses.

Figure 9:
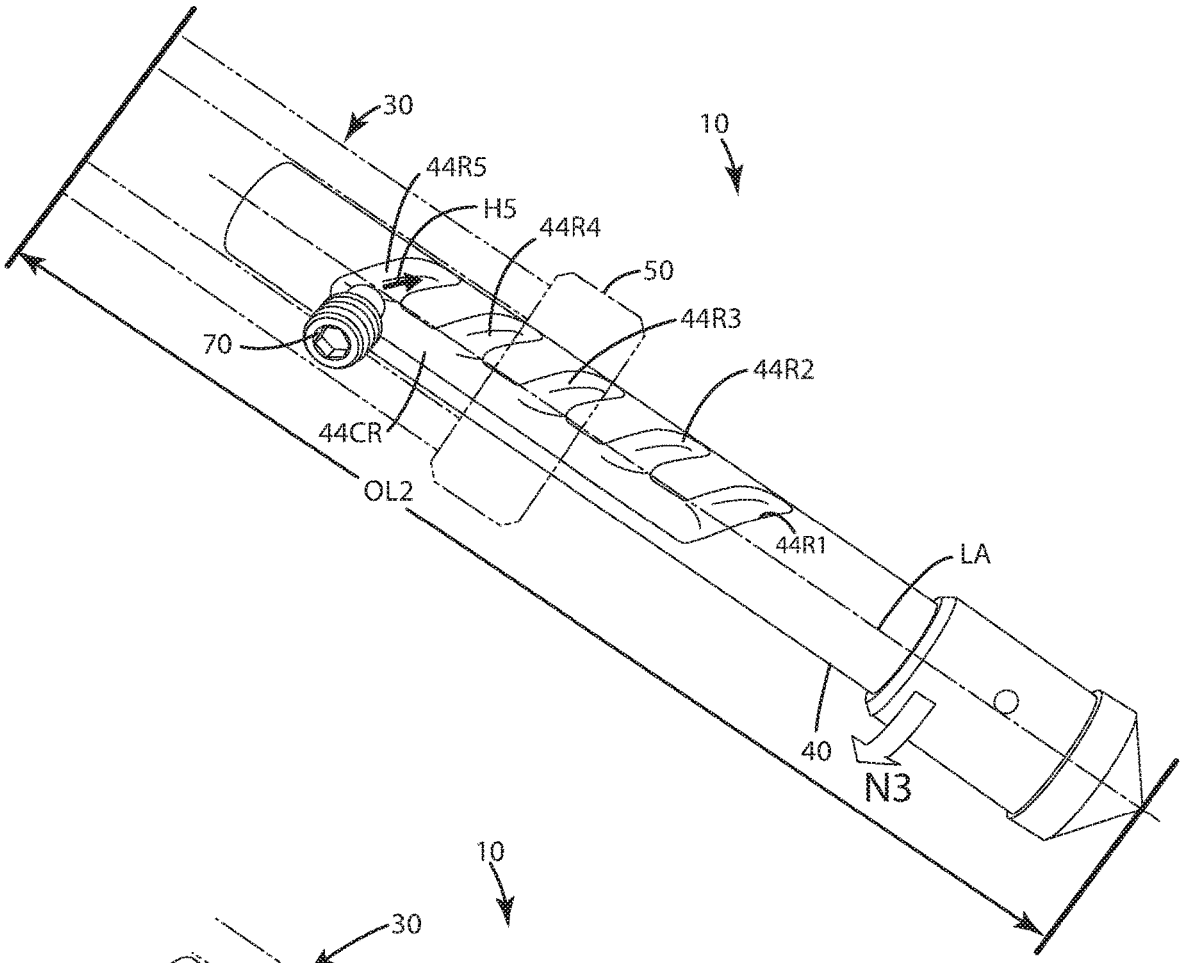
FIG. 9 is a side view of the leg being rotated in a second, opposite direction to transition the guide element into a second recess in the guide portion of the leg, to transition the leg back to a locked mode.
Figure 10:
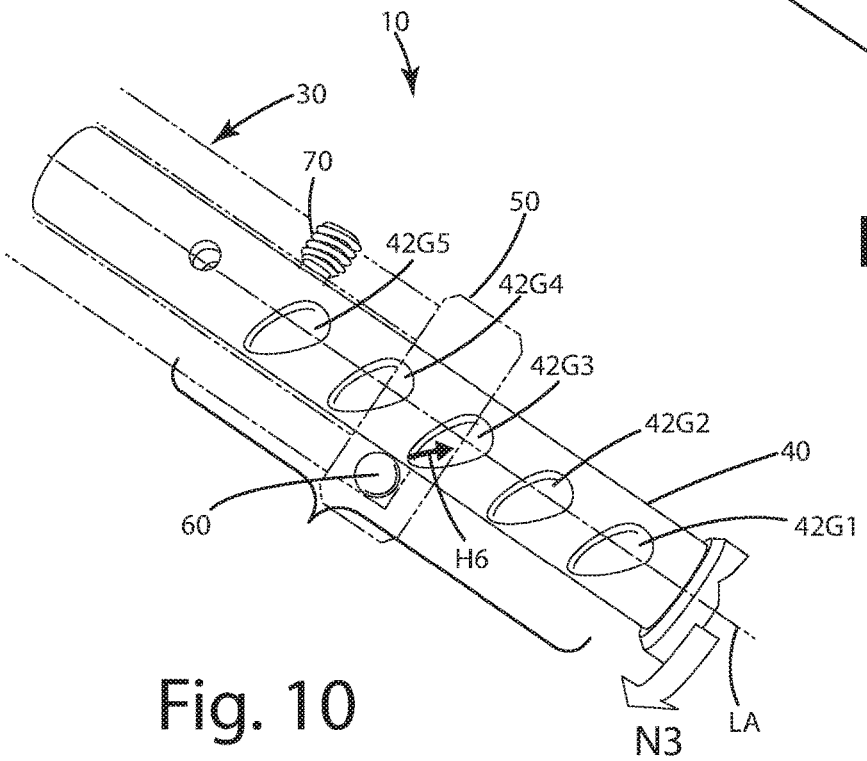
FIG. 10 is a side view of the leg being rotated in the second, opposite direction to transition the lock element into a second groove in the locking portion of the leg, to transition the leg back to a locked mode.

While the leg is in the adjustment mode, again the support tube and leg can move in a telescoping manner relative to one another to increase and/or decrease the overall length OL1 of the support pod 10. As shown in FIGS. 1, 3, and 9, the overall first overall length OL1 can be increased to a second overall length OL2 that is greater than the first overall length OL1. Of course, the overall length OL, alternatively can be decreased depending on the application and desire of the user operating the support pod.

After a user has pulled the leg 40 from the support tube 30 a preselected amount with their one hand, the user can then rotate the leg 40 relative to the support tube in a second direction, optionally opposite the first direction mentioned above, to transition leg from the adjustment mode to another locked mode. For example, with reference to FIGS. 9 and 10, the user can rotate the leg 40 in direction N3 relative to the support tube 30. As this occurs, the leg 40 rotates in such a manner such that the guide element 70 enters a second recess 44R5 in direction H5 from the common recess 44CR. The lock element 60 also enters the second groove 42G3 in direction H6. With the guide element entering the second recess and the lock element entering the second groove, the leg can transition from the adjustment mode to another locked mode. In this second locked mode, the overall length of the pod has been converted to the second overall length OL2. Thus, the leg and support tube telescoped relative to another, and the overall length of the support pod 10 has increased. This in turn will raise the weapon 10 higher, away from an underlying support surface to prepare the weapon for firing.

Incidentally, if the user checks the sights of the weapon 100 and determines that the overall length and thus the height of the bipod is still not set at an appropriate level, the user can with a single hand, rotate the leg again to transition it from a locked mode to an adjustment mode, and either increase or decrease the overall length of the support pod by allowing the leg to retract into the support pod (which it does under the force the spring) or by pulling on the leg with a force to extract or extend from the support tube. A user can do this multiple times, in multiple iterations to attain a desired overall length of the support pod. After that is achieved, and user wants to further secure the leg position, the user can with the same hand rotate the locking ring 50 relative to the support tube and thereby ride the ramp surface along the lock element until the lock element 60 is adequately nested in and forcibly pushed into the respective groove. Of course, if the user forgets to or does not want to rotate and lock the locking ring and/or leg in the secondary locked mode, the user can leave it free.

As mentioned above, under the force of gravity, the guide element 70 and the lock element 60 will naturally ride into lower portions of the respective recess and groove. The guide element will thus bottom out against the lower portion 49R4 of the respective recess when the locked mode is attained or close to being attained. With this interaction of the guide element and recess, it is unlikely that the leg will be inadvertently retracted and/or extended from the tube to change the overall length from that set by the user.

Figure 11:
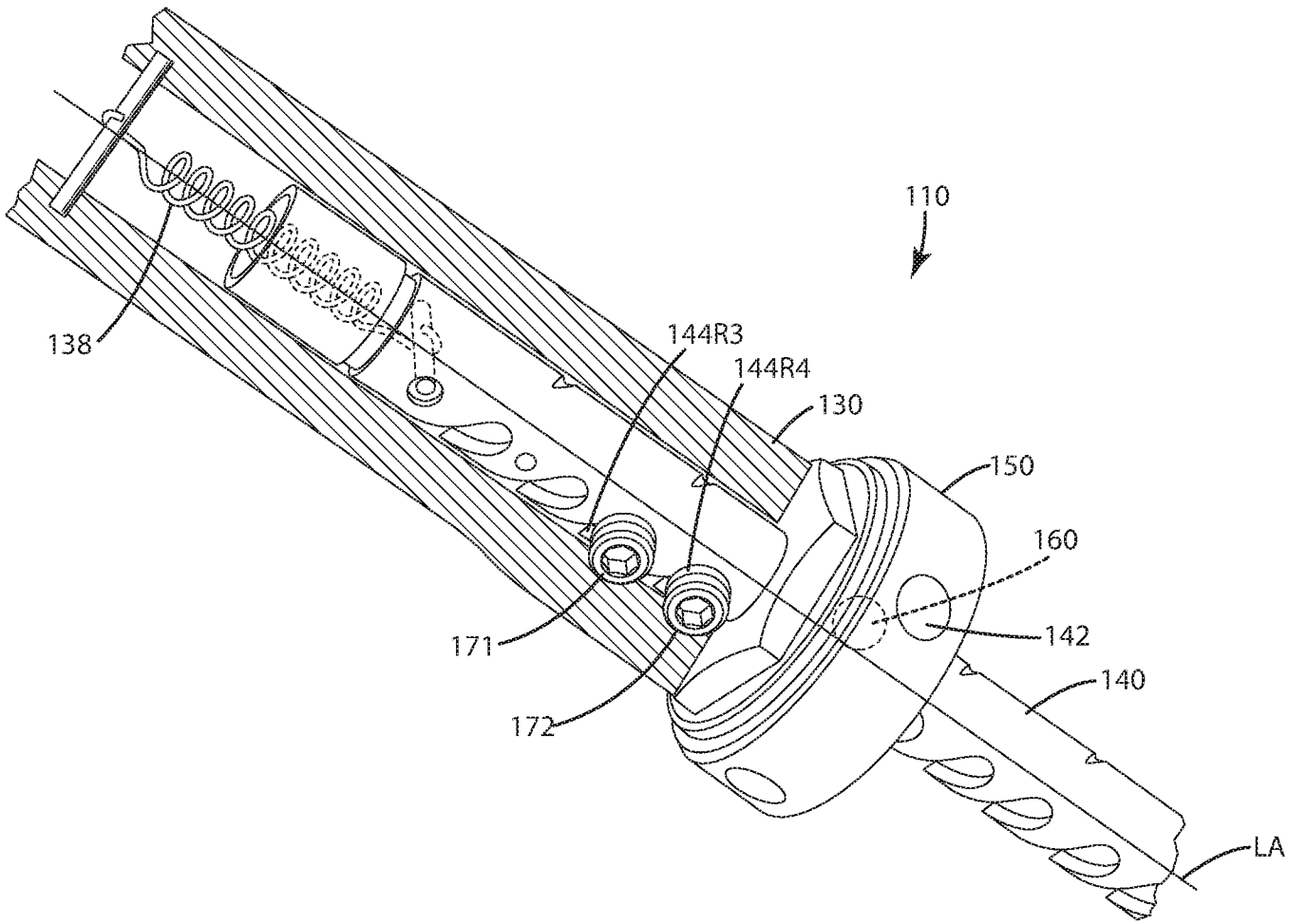
FIG. 11 is a partial section view of a first alternative embodiment of the support pod having a pair of guide elements that engage a pair of recesses.

A first alternative embodiment of the support pod is shown in FIG. 11 and generally designated 110. This support pod is similar in structure, function and operation to the support pod described above with several exceptions. For example, the support pod can include a support tube 130 and a support leg 140. A locking ring 150 can engage a lock element 160 in a respective groove 142. The leg 140 can be biased upward and into the tube interior via a spring 138. In this embodiment, however, the support leg 140 can include first 171 and second 172 guide elements. The guide elements can be offset from one another along the longitudinal axis LA of the leg 140. Each of the guide elements 171 and 172 can engage respective recesses 144R3 and 144R4 simultaneously. Thus, the guide elements can be paired to provide extra support and stability between the support tube associated with two pair of guide elements and the associated pair of recesses defined by the leg. As will be appreciated, multiple additional guide elements can be added to the support tube to provide additional support, depending on the application.

Optionally, as shown in FIGS. 1 and 12-14, the base 20 can include support flanges that define one or more notches 20N, such as exemplary notches N1, N2 and N3. These multiple notches can be radially spaced about an axis 24FAX of the fastener 24F at preselected angles. A1, A2 and A3 shown, for example in FIG. 12. These angles can be selected so that when they are engaged by the holder pin 25, that holder pin 25 will hold the pod, in the particular angular orientation. For example, when the holder pin 25 is in the notch NI, the support tube 30 and leg 40 can be disposed at the angle A1, which can be 180° relative to horizontal. This can enable the tube and leg to lay parallel to the barrel of the weapon, in a storage mode for low profile transport. When the holder pin is in notch N2, the tube and leg can be supported at angle A2, which can be 45° relative to horizontal. When the holder pin 25 is in notch N3, the tube and leg can be supported at angle A3, which can be 90° relative to horizontal. The number and configurations of the notches can be modified depending on the desired angular orientations of the tube and legs, and the resulting stance and orientation of the weapon supported by the same.

Figure 12:
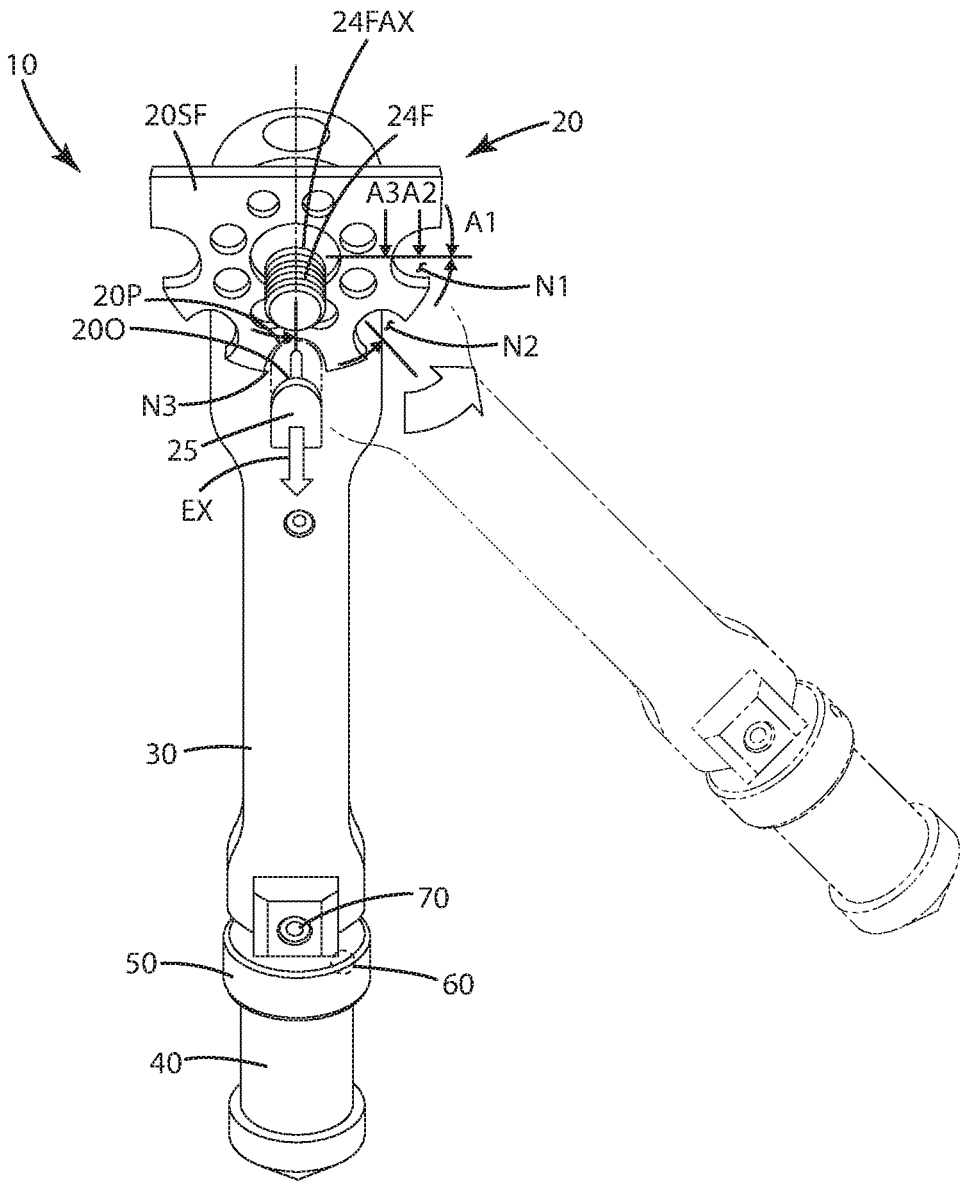
FIG. 12 is a side view of an angular leg adjustment assembly of the support pod, showing a first angled position in solid lines and a second angled position in broken lines.
Figure 13:
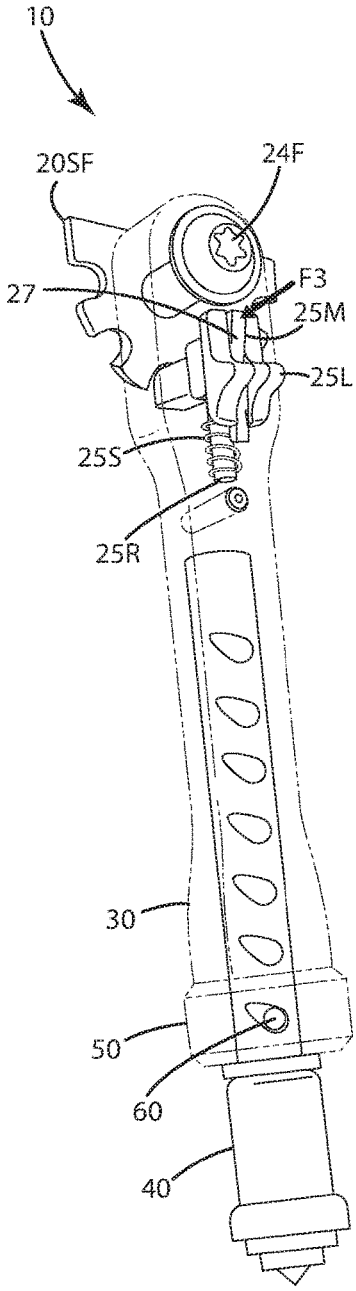
FIG. 13 is another side view of the angular adjustment assembly having a lock latch actuated with a force to free a holding slide so that a holding element can be freed from an angular notch so that the support tube and leg can be angularly rotated.
Figure 14:
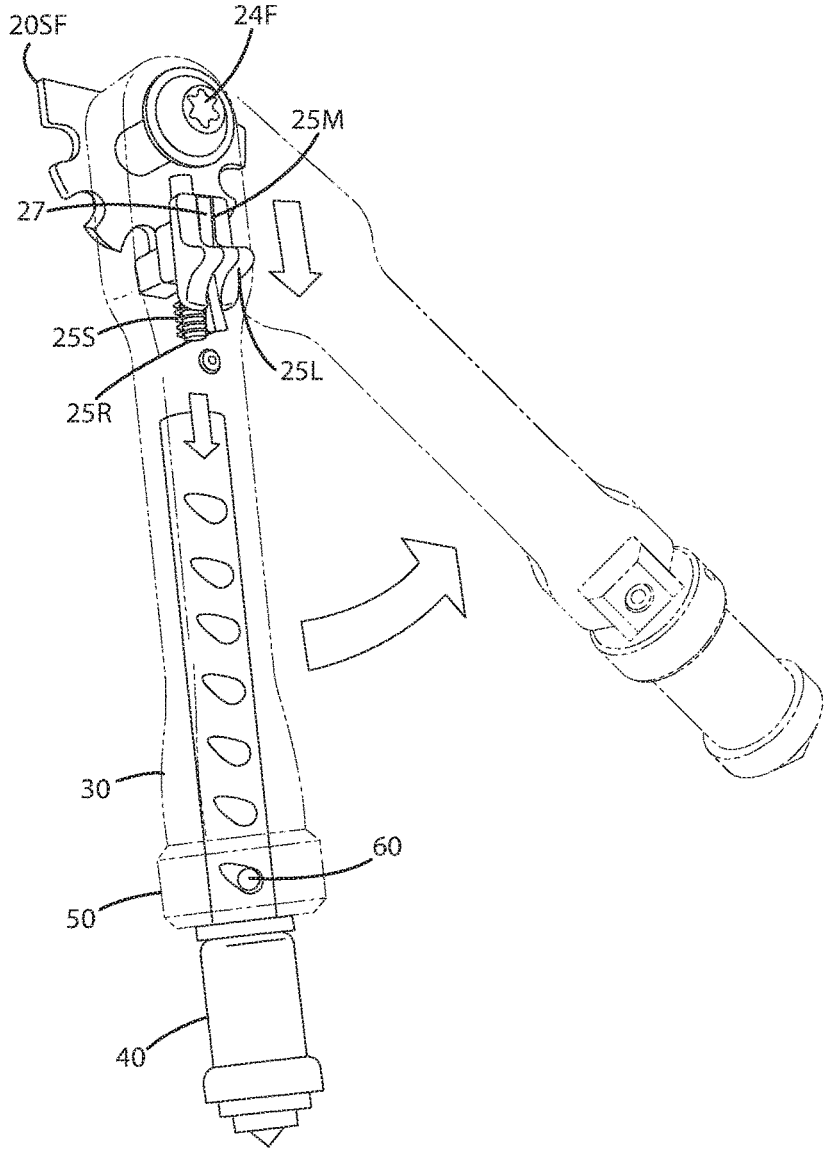
FIG. 14 is another side view of the support tube and leg being rotated angularly to another angle in broken lines.

As shown in FIG. 12, the notches 20N can be open sided notches having a perimeter 20P with an outward facing, or radial opening 20O. The holder pin 25 can exit the notch in direction EX, moving radially away from the axis 24FAX, and out the opening 20O so that the pin no longer engages the respective notch, and thus the tube and leg can be moved or rotated to the configurations shown in broken lines in FIG. 12 while the holder pin is disengaged from the notch N3. As the tube and leg rotate, the associated flange 20SF can remain stationary with regard to the remainder of the base 20. After the pin has been moved a preselected amount to set an angle of the tube and leg, the pin can be placed in another selected notch, and the holder pin 25 can enter that notch through a similar opening 20O, until it rests in the notch.

The holder pin 25 can be a part of an adjuster assembly 26, which can further include a slide rod 25R upon which the pin 25 can move and/or slide down in direction EX, or up in an opposite direction. The holder pin 25 can be joined with a lever 25L that can be grasped by user to move the holder pin 25 in the direction EX or an opposite direction to unlock the pin from the notch and thereby move the tube and leg to another angular orientation. The lever and pin can be biased in a normally closed mode to hold the pin 25 in a notch 20N so that the tube and leg are supported by the pin in a particular orientation. The lever 25L can slide along an exterior of the support tube when it is actuated to move the holding pin 25.

Figure 15:
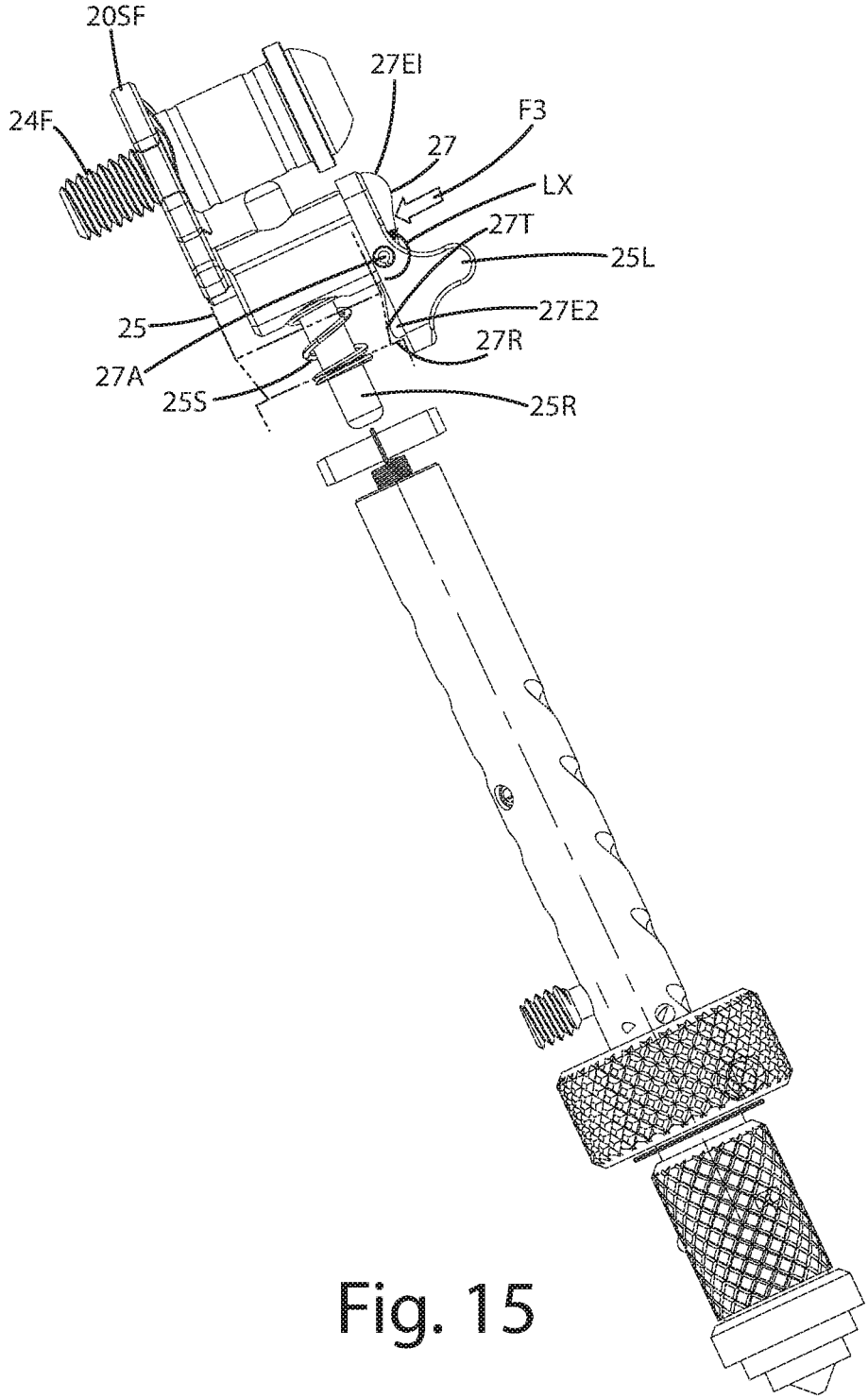
FIG. 15 is a side cutaway view showing a lock and latch of the angular adjustment assembly.

The lever 25L optionally can be locked in place via a latch 27. The latch can pivot about a pin or axis 27A, and can include a first end 27E1 and a second end 27E2. The first end 27E1 can be engaged by a force F3, which rotates the latch about the axis 27A in direction LX (FIG. 15). This in turn releases the tooth 27T at the second end 27E2 from the recess 27R which can be defined by the tube or leg. In turn, the lever 25L can be moved, for example slid in direction EX, to move the pin 25 out of the notch. When the pin is set in another notch and the lever is released, the lever can return under the force of the spring 25S to its previous position, with the latch tooth reengaging the recess to lock the support tube and leg in the next selected orientation. With the latch locking the lever, the support tube and leg can be secured well in a particular angular orientation, without risk of being inadvertently bumped or moved. Of course, other types of latches or locks can be used to secure the angular disposition of the support tube and leg when desired.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiment of the invention in which an exclusive property or privilege is claimed are defined as follows:

1. A support pod configured to support a weapon in a firing position, the support pod comprising:

a base configured to engage the weapon when the weapon is oriented to shoot a projectile from the weapon at a target;

a support extending downward from the base, the support including an exterior and an interior;

a guide element extending into the interior of the support;

a leg telescopingly joined with the support, the leg including a longitudinal axis and a guide portion, the guide portion defining a plurality of recesses;

wherein the plurality of recesses are transverse to the longitudinal axis of the leg and are downwardly inclined relative to the longitudinal axis, wherein the guide element is movably disposed in at least one of the plurality of recesses such that the guide element is configured to move at least one of into and out from each recess, wherein the leg is operable in a locked mode and an adjustment mode, wherein in the locked mode, the guide element is in a first one of the plurality of recesses, wherein in the adjustment mode, the guide element is removed from the plurality of recesses, wherein in the adjustment mode, the leg is movable relative to the support such that an overall length of the support pod is adjustable, whereby a user is able to adjust the overall length and thereby orient the weapon to fire the weapon at a target.

2. The support pod of claim 1, wherein the leg includes a neutral landing disposed adjacent the plurality of recesses, wherein the guide element is adjacent the neutral landing, and out of the plurality of recesses, in the adjustment mode.

3. The support pod of claim 2, wherein the neutral landing is a part of a secondary common recess that extends parallel to the longitudinal axis of the leg, wherein the secondary common recess transitions to a plurality of openings of the plurality of recesses.

4. The support pod of claim 1, wherein the guide element is a fastener configured to extend into and move relative to at least one of the plurality of recesses and the secondary common recess.

5. The support pod of claim 4, wherein the support is in the form of a tubular cylinder;

wherein the fastener is accessible from the exterior of the support and extends through a hole defined in the support.

6. The support pod of claim 1, comprising:

a lock ring rotatably joined with the support, wherein the lock ring is disposed adjacent a lock element adjacent the leg, wherein the lock ring is configurable to engage the lock element with the leg in the locked mode.

7. The support pod of claim 6, wherein the lock ring defines a ramped surface extending about the longitudinal axis, wherein the lock ring is rotatable relative to the leg such that the lock element rolls relative to the ramped surface.

8. The support pod of claim 1, wherein the plurality of recesses are adjacent a common neutral landing, wherein each of the plurality of recesses branch transversely away from the neutral landing, wherein the neutral landing is parallel to the longitudinal axis.

9. The support pod of claim 1, wherein each of the plurality of recesses are downwardly angled relative to the longitudinal axis at an angle of at least 45°.

10. The support pod of claim 1, wherein the guide element is configured to track in at least one of the plurality of recesses under the force of gravity so that the guide element bottoms out against a lower recess part in the at least one of the plurality of recesses in the locked mode.

11. The support pod of claim 1, comprising:

a cylindrical surface forming a portion of the leg, wherein the plurality of grooves are defined in the cylindrical surface, wherein the guide element is configured to move adjacent the cylindrical surface and into at least one of the plurality of recesses when the guide element is transitioning toward the locked mode.

12. A support pod configured to support a weapon in a firing position, the support pod comprising:

a base configured to engage the weapon when the weapon is oriented to fire at a target;

a support joined with the base;

a leg telescopingly joined with the support, the leg including a longitudinal axis;

a guide portion defining a plurality of recesses that spiral downwardly about the longitudinal axis;

a guide element movably disposed in at least one of the plurality of recesses such that the guide element is configured to move at least one of into and out from the at least one of the plurality of recesses when the leg operates in at least one of a locked mode and an adjustment mode.

13. The support pod of claim 12, wherein in the locked mode, the guide element is in a first one of the plurality of recesses, wherein in the adjustment mode, the guide element transitions out from the first one of the plurality of recesses, wherein in the adjustment mode, the leg is movable relative to the support such that an overall length of the support pod is adjustable from a first overall length to a different, second overall length.

14. The support pod of claim 12, wherein each of the plurality of recesses includes an angled bottom.

15. The support pod of claim 12, wherein each of the plurality of recesses has a substantially constant depth from a first end to a second end of each recess.

16. The support pod of claim 12, wherein the guide element is a fastener having a distal tip that is slidably disposed in the at least one of the plurality of recesses.

17. The support pod of claim 12, wherein the guide element is configured to ride along a neutral landing when in the adjustment mode, wherein the guide element is configured to diverge away from the neutral landing end into a first recess when transitioning to the locked mode.

18. A method of using a support pod to orient a weapon in a firing configuration, the method comprising:

engaging a base adjacent a first surface of a weapon;

projecting a support and a leg away from the base;

rotating the support and leg relative to one another in a first direction to transition the leg from a first locked mode, in which a guide element is disposed in a first recess that is downwardly angled relative to a longitudinal axis of the leg to a first adjustment mode, in which the guide element is removed from the first recess;

moving the support and the leg in a telescoping manner relative to one another to at least one of increase and decrease an overall length of the support pod; and rotating the support and leg relative to one another in a second direction opposite the first direction to transition the leg from the first adjustment mode to a second locked mode, whereby a user is able to adjust the overall length and thereby orient the weapon supported on the support pod in a predetermined configuration to fire the weapon at a target.

19. The method of claim 18, wherein in the second locked mode, the guide element is disposed in a second recess that is downwardly angled relative to the longitudinal axis of the leg.

20. The method of claim 18 comprising:

rotating a lock ring about the longitudinal axis so that a lock element, unlocks the leg before the rotating the support and leg relative to one another.

* * * * *